US010176757B2

(12) United States Patent
Wang

(10) Patent No.: US 10,176,757 B2
(45) Date of Patent: Jan. 8, 2019

(54) PIXEL CIRCUIT AND DRIVING METHOD THEREOF, AND DISPLAY DEVICE

(71) Applicant: BOE TECHNOLOGY GROUP CO., LTD., Beijing (CN)

(72) Inventor: Lirong Wang, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 186 days.

(21) Appl. No.: 15/224,869

(22) Filed: Aug. 1, 2016

(65) Prior Publication Data

US 2017/0278458 A1 Sep. 28, 2017
US 2018/0137823 A9 May 17, 2018

(30) Foreign Application Priority Data

Mar. 25, 2016 (CN) ..... 2016 1 0179061

(51) Int. Cl.
*G09G 3/3258* (2016.01)

(52) U.S. Cl.
CPC ... *G09G 3/3258* (2013.01); *G09G 2300/0819* (2013.01); *G09G 2310/0262* (2013.01); *G09G 2310/08* (2013.01); *G09G 2320/0233* (2013.01); *G09G 2320/045* (2013.01)

(58) Field of Classification Search
CPC ... G09G 2300/0819; G09G 2320/0233; G09G 3/3291; G09G 3/3258; G09G 2310/08; G09G 2300/043
See application file for complete search history.

(56) References Cited

U.S. PATENT DOCUMENTS

2011/0221791 A1* 9/2011 Kajiyama ..... G09G 3/3233 345/690
2015/0356924 A1* 12/2015 Chen ..... G09G 3/3233 345/690

FOREIGN PATENT DOCUMENTS

CN 102654972 A 9/2012
CN 203085137 U 7/2013
(Continued)

OTHER PUBLICATIONS

Joon-Chul Goh et al., "A New a-Si:H Thin-Film Transistor Pixel Circuit for Active-Matrix Organic Light-Emitting Diodes" IEEE Electron Device Letters | vol. 24 | No. 9, Sep. 2003, 3 pages (583-585).

(Continued)

*Primary Examiner* — Nelson Rosario
*Assistant Examiner* — Scott Au
(74) *Attorney, Agent, or Firm* — Armstrong Teasdale LLP

(57) ABSTRACT

A pixel circuit is provided. The pixel circuit includes a drive module, a collection module, a data write module, a storage module, a light emission control module, and a light emission module, wherein the data write module is configured to write a voltage at a data signal terminal into the storage module, wherein the collection module is configured to collect a threshold voltage of the drive module and write the threshold voltage into the storage module, wherein the storage module is configured to store a driving voltage for driving the drive module, wherein the drive module is configured to drive the light emission module to emit light according to the driving voltage stored by the storage module, and wherein the light emission control module is configured to control the drive module for driving the light emission module.

18 Claims, 7 Drawing Sheets

(56) References Cited

FOREIGN PATENT DOCUMENTS

| | | | |
|---|---|---|---|
| CN | 203733448 | U | 7/2014 |
| WO | 2013037295 | A1 | 3/2013 |

OTHER PUBLICATIONS

China First Office Action, Application No. 201610179061.8, dated Oct. 10, 2017, 15 pps.: with English translation.

* cited by examiner

PIXEL CIRCUIT AND DRIVING METHOD THEREOF, AND DISPLAY DEVICE

CROSS-REFERENCES TO RELATED APPLICATIONS

This application claims the benefit and priority of Chinese Patent Application No. 201610179061.8, filed on Mar. 25, 2016, the entire content of which is incorporated by reference herein.

BACKGROUND

The present disclosure relates to the field of display technology, and particularly to a pixel circuit and a driving method thereof, and a display device.

With the development of display technology, Organic Light emission Diode (OLED) as a current-type light emission device, is increasingly being used in the high performance display field, because of its advantages of self-emission, fast response, wide viewing angle, and being manufacturable on a flexible substrate and the like.

An OLED display device includes a plurality of OLED pixel circuit structures. The OLED pixel circuit structure includes an OLED and a plurality of driving transistors. The OLED pixel circuit controls current flowing through the OLED with the driving transistors. The OLED pixel circuit generally includes two driving transistors, one capacitor and one OLED. The two driving transistors are capable of generating a driving current for driving the OLED according to the data voltage at a data signal terminal, and the value of the driving current is correlated with the threshold voltage (Vth) of the driving transistors.

In a case that the driving transistors of different pixel circuits have different Vths or the Vth of the same driving transistor drifts with time, the currents flowing through the OLED in the pixel circuit vary, even corresponding to the same data voltage. This causes low uniformity of display luminance of an OLED display panel and bad display effect.

BRIEF DESCRIPTION

Embodiments of the present disclosure provide a pixel circuit and a driving method thereof, and a display device.

According to a first aspect of the present disclosure, there is provided a pixel circuit. The pixel circuit includes a drive module, a collection module, a data write module, a storage module, a light emission control module and a light emission module. The data write module is connected to the storage module, and is configured to write a voltage at a data signal terminal into the storage module. The collection module is connected to the storage module and the drive module, and is configured to collect a threshold voltage of the drive module and write it into the storage module. The storage module is connected to the drive module, and is configured to store a driving voltage for driving the drive module. The drive module is connected to the light emission control module, and is configured to drive the light emission module to emit light according to the driving voltage stored by the storage module. The light emission control module is connected to the light emission module, and is configured to control the drive module for driving the light emission module.

According to the embodiments of the present disclosure, a connection point connecting the drive module and the storage module is a first control point. A connection point connecting the drive module and the collection module is a second control point. A connection point connecting the data write module and the storage module is a third control point. The drive module is connected to a first power supply signal terminal, the first control point and the second control point, respectively, and is configured to write an input voltage at the first power supply signal terminal into the second control point under the control of a voltage at the first control point. The collection module is connected to a first control signal terminal, the first control point and the second control point respectively, and is configured to write the voltage at the second control point into the first control point according to a first control signal inputted from the first control signal terminal. The data write module is connected to the data signal terminal, the first control signal terminal and the third control point, respectively, and is configured to write the voltage at the data signal terminal into the third control point according to the first control signal inputted from the first control signal terminal. The storage module is connected to the first control point and the third control point, respectively, and is configured to store the voltages at the first control point and at the third control point. The light emission control module is connected to the second control point, the third control point, the second control signal terminal, a second power supply signal terminal and the light emission module, respectively, and is configured to control the light emission module to emit light according to the voltage at the second control point, the voltage at the third control point, a second control signal from the second control signal terminal and a voltage at the second power supply signal terminal. The light emission module is connected to the light emission control module, and is configured to emit light under the control of the light emission control module.

According to the embodiments of the present disclosure, the drive module includes a first transistor. The first electrode of the first transistor is connected to the first power supply signal terminal, the second electrode of the first transistor is connected to the second control point, and the control electrode of the first transistor is connected to the first control point.

According to the embodiments of the present disclosure, the collection module includes a second transistor. The first electrode of the second transistor is connected to the first control point, the second electrode of the second transistor is connected to the second control point, and the control electrode of the second transistor is connected to the first control signal terminal.

According to the embodiments of the present disclosure, the data write module includes a third transistor. The first electrode of the third transistor is connected to the data signal terminal, the second electrode of the third transistor is connected to the third control point, and the control electrode of the third transistor is connected to the first control signal terminal.

According to the embodiments of the present disclosure, the storage module includes a capacitor, one end of the capacitor is connected to the third control point, the other end of the capacitor is connected to the first control point.

According to the embodiments of the present disclosure, the light emission control module includes a fourth transistor and a fifth transistor. The first electrode of the fourth transistor is connected to the third control point, the second electrode of the fourth transistor is connected to the second power supply signal terminal, and the control electrode of the fourth transistor is connected to the second control signal terminal. The first electrode of the fifth transistor is connected to the second control point, the second electrode of the fifth transistor is connected to the light emission module, and the control electrode of the fifth transistor is connected to the second control signal terminal.

According to the embodiments of the present disclosure, the light emission module includes an organic light emission diode, one end of the organic light emission diode is connected to the light emission control module, the other end of the organic light emission diode is grounded.

According to the embodiments of the present disclosure, the transistor is an N-type transistor.

According to a second aspect of the present disclosure, there is provided a pixel circuit driving method, for a pixel circuit according to the first aspect. The pixel circuit driving method includes a first phase, in which the light emission control module disconnects the drive module and the light emission module, the data write module writes the voltage at the data signal terminal into the storage module, the collection module collects the threshold voltage of the drive module and writes it into the storage module, and a second phase, in which the light emission control module connects the drive module and the light emission module. The drive module drives the light emission module to emit light according to the driving voltage stored by the storage module.

According to the embodiments of the present disclosure, the connection point connecting the drive module and the storage module is a first control point. The connection point connecting the drive module and the collection module is a second control point. The connection point connecting the data write module and the storage module is a third control point. In the first phase, an ON signal is inputted from a first control signal terminal, a first voltage is inputted from a first power supply signal terminal, a data voltage is inputted from a data signal terminal, such that the data voltage is written into the third control point, the first voltage is written into the second control point and the first control point. In the second phase, an OFF signal is inputted from the first control signal terminal, an ON signal is inputted from the second control signal terminal, the second voltage is inputted from a second power supply signal terminal, such that the second voltage is written into the third control point to drive the light emission module to emit light via the current from the light emission control module.

According to the embodiments of the present disclosure, the drive module includes a first transistor, the collection module includes a second transistor, the data write module includes a third transistor, the storage module includes a capacitor, the light emission control module includes a fourth transistor and a fifth transistor, the light emission module includes an organic light emission diode. In the first phase, an ON signal is inputted from the first control signal terminal, a first voltage is inputted from the first power supply signal terminal, a data voltage is inputted from the data signal terminal, the second transistor and the third transistor are turned on, the second transistor writes the first voltage into the first control point, the third transistor writes the data voltage into the third control point, the capacitor stores the voltages at the first control point and at the third control point. In the second phase, an OFF signal is inputted from the first control signal terminal, an ON signal is inputted from the second control signal terminal, the second voltage is inputted from the second power supply signal terminal, the fourth transistor and the fifth transistor are turned on, the fourth transistor writes the second voltage at the second control point into the third control point, the fifth transistor writes the data voltage into the light emission module to drive the light emission module to emit light.

According to the embodiments of the present disclosure, the transistor is an N-type transistor.

According to a third aspect of the present disclosure, there is provided a display device. The display device includes a pixel circuit according to the first aspect.

The embodiments of the present disclosure provide a pixel circuit and a driving method thereof, and a display device, the pixel circuit includes a drive module, a collection module, a data write module, a storage module, a light emission control module and a light emission module, the drive module is capable of writing the input voltage at a first power supply signal terminal into a second control point, the collection module is capable of writing the voltage at the second control point into a first control point, the data write module is capable of writing the voltage at a data signal terminal into a third control point, the storage module is capable of storing the voltages at the first and third control points, the light emission control module is capable of controlling the light emission module to emit light under the control of the second control point, the third control point, a second control signal terminal and a second power supply signal terminal, the value of the driving current for driving the light emission module is incorrelated with the threshold voltage of the driving transistor in the pixel circuit, thus avoiding the impact of the threshold voltage of the driving transistor on the display effect, increasing uniformity of display luminance of an OLED display panel, and improving the display effect of the OLED display panel.

BRIEF DESCRIPTION OF THE DRAWINGS

In order to more clearly illustrate the technical solutions in the embodiments of the present disclosure, the drawings in the embodiments will be briefly described below. Apparently, the drawings described below are only for some embodiments of the present disclosure. Those of ordinary skill in the art may also obtain other drawings from these drawings without creative work.

DETAILED DESCRIPTION

Figure 1:
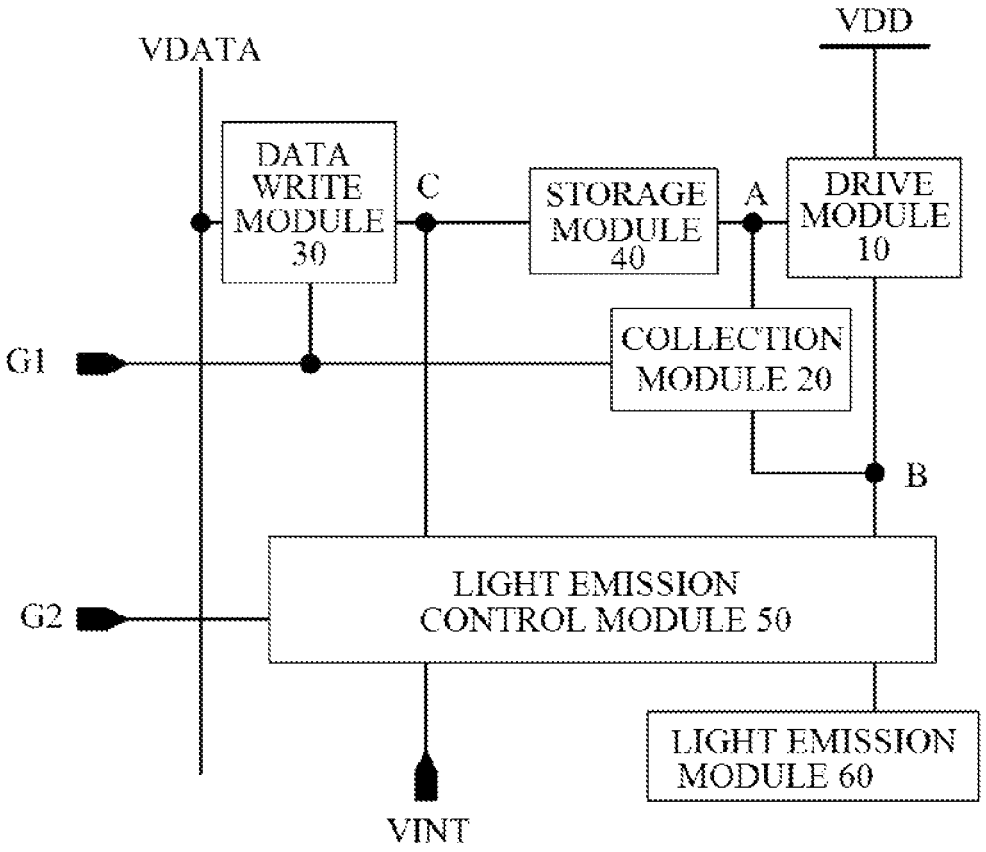
FIG. 1 is a schematic structural diagram of a pixel circuit provided by an embodiment of the present disclosure.

To make the technical solutions and advantages of the present disclosure clearer, embodiments of the present disclosure will be further described in detail below with reference to the accompanying drawings.

In the embodiments of the present disclosure, the transistors may be thin film transistors or Filed Effect Transistor, and can be replaced by other devices with the same features. According to their functions in the circuit, the transistors employed in the embodiment of the present disclosure are divided into driving transistors and switching transistors. Since the sources and drains of the driving transistors and switching transistors employed are symmetrical, their sources and drains are interchangeable. Further, in order to distinguish the respective electrodes of the transistors, it is specified according to forms in the drawings that the intermediate terminal of the transistor is the gate, the signal input terminal is the source, the signal output terminal is the drain. Also, the gate can also be called the control electrode, the source called the first electrode, the drain called the second electrode.

In embodiments of the present disclosure, the description is performed by example of N-type transistor, that is, the used switching transistor is an N-type switching transistor, which is turned on when the control electrode is at a high level, and is turned off when the control electrode is at a low level; the driving transistor is an N-type transistor, the voltage of the control electrode of the N-type driving transistor is a high level (the voltage of the control electrode is greater than the voltage of the source), and is in an amplified state or saturated state when the absolute value of voltage difference between the control electrode and the source is greater than the threshold voltage.

FIG. 1 is a schematic structural diagram of a pixel circuit provided by an embodiment of the present disclosure. As shown in FIG. 1, the pixel circuit includes a drive module 10, a collection module 20, a data write module 30, a storage module 40, a light emission control module 50 and a light emission module 60.

The data write module 30 is connected to the storage module 40, and is configured to write the voltage at a data signal terminal VDATA into the storage module 40. The collection module 20 is connected to the storage module 40 and the drive module 10, and is configured to collect the threshold voltage of the drive module 10 and write it into the storage module 40. The storage module 40 is connected to the drive module 10, and is configured to store the driving voltage for driving the drive module 10. The drive module 10 is connected to the light emission control module 50, and is configured to drive the light emission module 60 to emit light according to the driving voltage stored by the storage module 40. The light emission control module 50 is connected to the light emission module 60, and is configured to control the drive module 10 for driving the light emission module 60.

The connection point connecting the drive module 10 and the storage module 40 is a first control point A. The connection point connecting the drive module 10 and the collection module 20 is a second control point B. The connection point connecting the data write module 30 and the storage module 40 is a third control point C.

The drive module 10 is connected to a first power supply signal terminal VDD, the first control point A and the second control point B respectively, and is configured to write the input voltage at the first power supply signal terminal VDD into the second control point B under the control of the voltage at the first control point A.

The collection module 20 is connected to a first control signal terminal G1, the first control point A and the second control point B respectively, and is configured to write the voltage at the second control point B into the first control point A according to a first control signal input from the first control signal terminal G1.

The data write module 30 is connected to the data signal terminal VDATA, the first control signal terminal G1 and the third control point C respectively, and is configured to write the voltage at the data signal terminal VDATA into the third control point C according to the first control signal input from the first control signal terminal G1.

The storage module 40 is connected to the first control point A and the third control point C respectively, and is configured to store the voltages at the first control point A and at the third control point C.

The light emission control module 50 is connected to the second control point B, the third control point C, the second control signal terminal G2, a second power supply signal terminal VINT and the light emission module 60 respectively, and is configured to control the light emission module 60 to emit light according to the voltage at the second control point B, the voltage at the third control point C, the second control signal from the second control signal terminal G2 and the voltage at the second power supply signal terminal VINT.

The light emission module 60 is connected to the light emission control module 50, and is configured to emit light under the control of the light emission control module 50.

An embodiment of the present disclosure provides a pixel circuit. The pixel circuit includes a drive module, a collection module, a data write module, a storage module, a light emission control module and a light emission module. The drive module is capable of writing the input voltage at a first power supply signal terminal into a second control point, the collection module is capable of writing the voltage at the second control point into a first control point, the data write module is capable of writing the voltage at a data signal terminal into a third control point, the storage module is capable of storing the voltages at the first and third control points, the light emission control module is capable of controlling the light emission module to emit light under the control of the second control point, the third control point, a second control signal terminal and a second power supply signal terminal. The value of the driving current for driving the light emission module is incorrelated with the threshold voltage of the driving transistor in the pixel circuit, thus avoiding the impact of the threshold voltage of the driving transistor on the display effect, increasing uniformity of display luminance of an OLED display panel, and improving the display effect of the OLED display panel.

Figure 2:
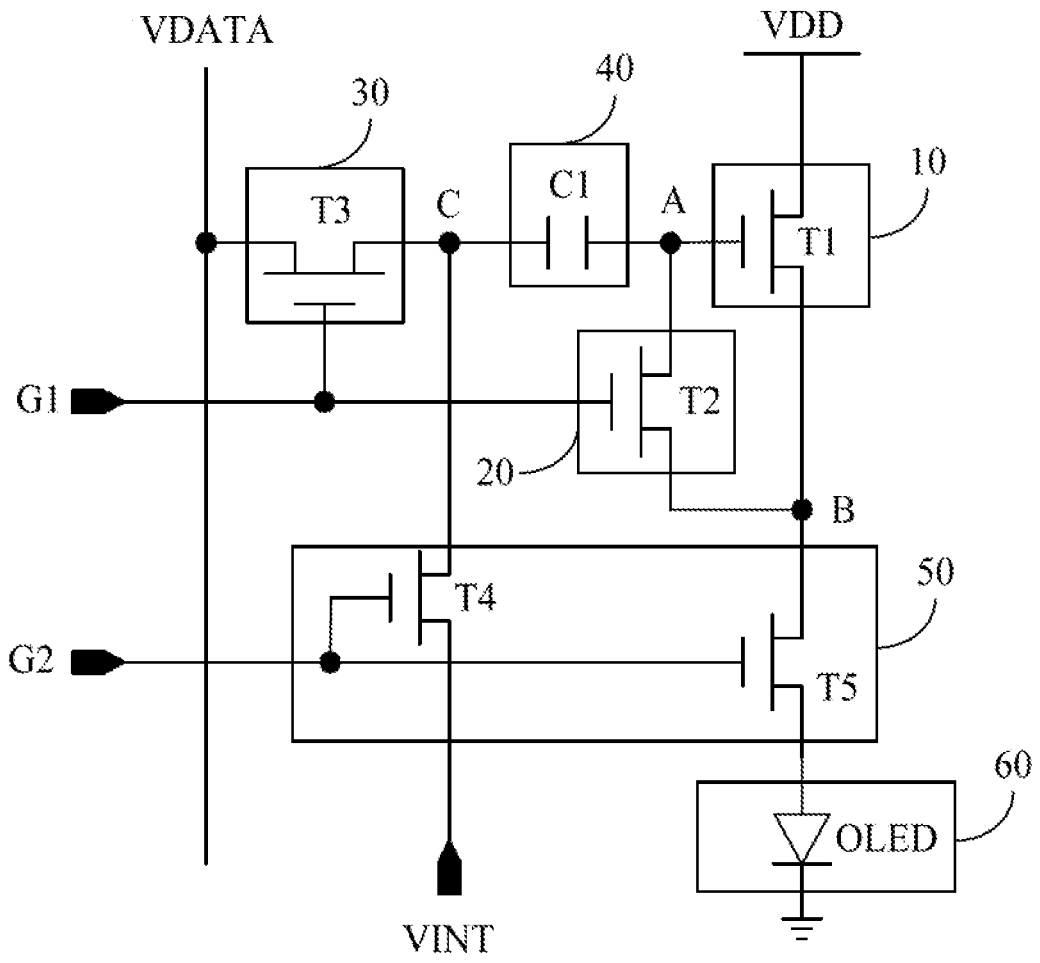
FIG. 2 is a schematic circuit diagram of the pixel circuit shown in FIG. 1.

FIG. 2 is a schematic circuit diagram of the pixel circuit shown in FIG. 1. As shown in FIG. 2, the drive module 10 includes a first transistor T1. The first electrode of the first transistor T1 is connected to the first power supply signal terminal VDD, the second electrode of the first transistor T1 is connected to the second control point B, and the control electrode of the first transistor T1 is connected to the first control point A.

Optionally, the collection module 20 may include a second transistor T2. The first electrode of the second transistor T2 is connected to the first control point A, the second electrode of the second transistor T2 is connected to the second control point B, and the control electrode of the second transistor T2 is connected to the first control signal terminal G1.

Optionally, the data write module 30 may include a third transistor T3. The first electrode of the third transistor T3 is connected to the data signal terminal VDATA, the second electrode of the third transistor T3 is connected to the third control point C, and the control electrode of the third transistor T3 is connected to the first control signal terminal G1.

Optionally, the storage module 40 may include a capacitor C1, one end of the capacitor C1 is connected to the third control point C, and the other end of the capacitor C1 is connected to the first control point A.

Optionally, the light emission control module 50 may include a fourth transistor T4 and a fifth transistor T5. The first electrode of the fourth transistor T4 is connected to the third control point C, the second electrode of the fourth transistor T4 is connected to the second power supply signal terminal VINT, and the control electrode of the fourth transistor T4 is connected to the second control signal terminal G2. The first electrode of the fifth transistor T5 is connected to the second control point B, the second electrode of the fifth transistor T5 is connected to the light emission module 60, and the control electrode of the fifth transistor T5 is connected to the second control signal terminal G2.

Optionally, the light emission module 60 may include an organic light emission diode OLED, one end of the organic light emission diode OLED is connected to the light emission control module 50, the other end of the organic light emission diode OLED is grounded.

Optionally, in the disclosed embodiment, the first to fifth transistors are N-type transistors.

An embodiment of the present disclosure provides a pixel circuit. The pixel circuit includes a drive module, a collection module, a data write module, a storage module, a light emission control module and a light emission module. The drive module is capable of writing the input voltage at a first power supply signal terminal into a second control point, the collection module is capable of writing the voltage at the second control point into a first control point, the data write module is capable of writing the voltage at a data signal terminal into a third control point, the storage module is capable of storing the voltages at the first and third control points, the light emission control module is capable of controling the light emission module to emit light under the control of the second control point, the third control point, a second control signal terminal and a second power supply signal terminal, the value of the driving current for driving the light emission module is incorrelated with the threshold voltage of the driving transistor in the pixel circuit, thus avoiding the impact of the threshold voltage of the driving transistor on the display effect, increasing uniformity of display luminance of an OLED display panel, and improving the display effect of the OLED display panel.

Figure 3:
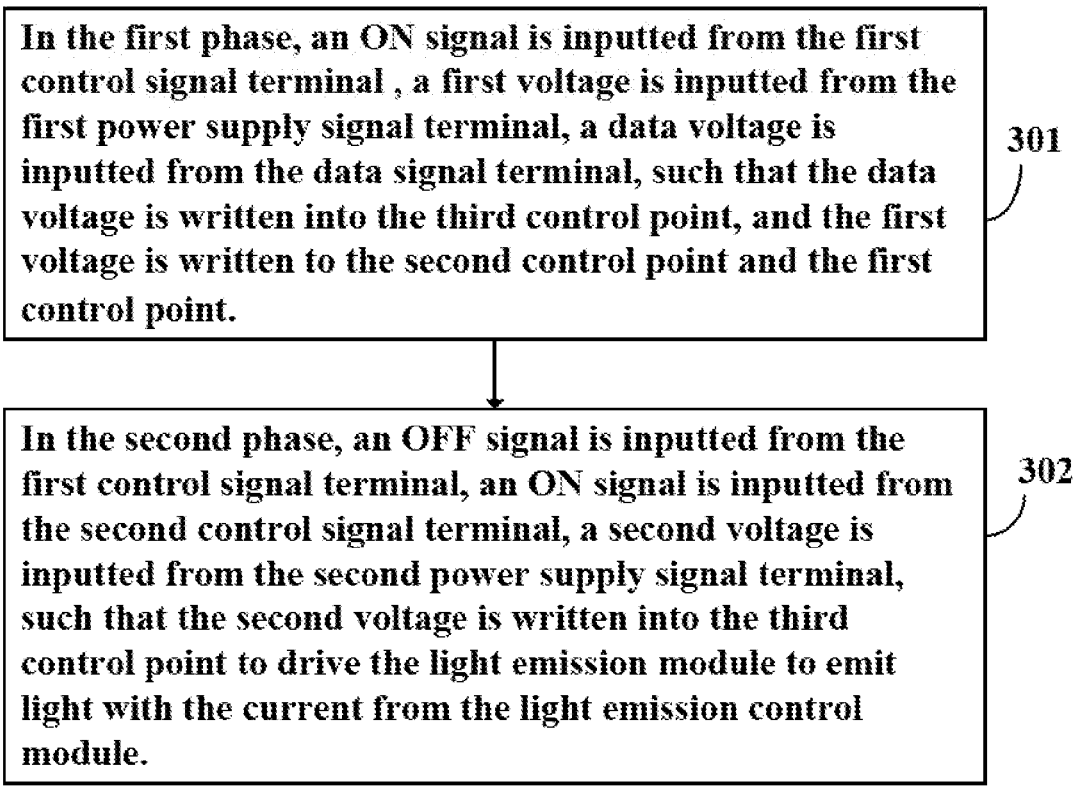
FIG. 3 is a flowchart of a driving method for the pixel circuit provided by an embodiment of the present disclosure.

FIG. 3 is a flowchart of a driving method for the pixel circuit provided by the embodiment of the present disclosure. The method may be used for a pixel circuit as shown in FIG. 1 or FIG. 2. As shown in FIG. 1, the pixel circuit may include a drive module 10, a collection module 20, a data write module 30, a storage module 40, a light emission control module 50 and a light emission module 60. The method includes a first phase, in which the light emission control module disconnects the drive module and the light emission module, the data writes module writes the voltage at the data signal terminal into the storage module, the collection module collects the threshold voltage of the drive module and writes it into the storage module, and a second phase, in which the light emission control module connects the drive module and the light emission module. The drive module drives the light emission module to emit light according to the driving voltage stored by the storage module.

As shown in FIG. 3, specifically, the driving method of the pixel circuit may include step 301, i.e., the first phase, in which an ON control is inputted from the first control signal terminal G1, a first voltage Vss is inputted from the first power supply signal terminal VDD, a data voltage Vdata is inputted from the data signal terminal VDATA, such that the data voltage Vdata is written into the third control point C, and the first voltage Vss is written to the second control point B and the first control point A. The method may further include step 302, i.e., the second phase, in which an OFF signal is inputted from the first control signal terminal G1, an ON signal is inputted from the second control signal terminal G2, the second voltage Vint is inputted from the second power supply signal terminal VINT, such that the second voltage Vint is written into the third control point C, and the light emission module 60 is driven to emit light with the current from the light emission control module 50.

An embodiment of the present disclosure provides a driving method of a pixel circuit. The method is capable of writing the data voltage inputted from the data signal terminal into the third control point, and writing the first voltage inputted from the first power supply signal temrinal into the second control point B and the first control point A in the first phase, and is capable of writing the second voltage inputted by the second power supply signal terminal into the third control point in the second phase and driving the light emission module to emit light with the current from the light emission control module. The value of the driving current for driving the light emission module is incorrelated with the threshold voltage of the driving transistor in the pixel circuit, thus avoiding the impact of the threshold voltage of the driving transistor on the display effect, increasing uniformity of display luminance of an OLED display panel, and improving the display effect of the OLED display panel.

Optionally, as shown in FIG. 2, the drive module 10 may include a first transistor T1, the collection module 20 may include a second transistor T2, the data write module 30 may include a third transistor T3, the storage module 40 may include a capacitor C1, the light emission control module 50 may include a fourth transistor T4 and a fifth transistor T5, the light emission module 60 may include an organic light emission diode OLED.

In the embodiments of the present disclosure, the first to fifth transistors may be N-type transistors, i.e., the first to fifth transistors are turned on when the voltage of the control electrode is in a high level.

Figure 4:
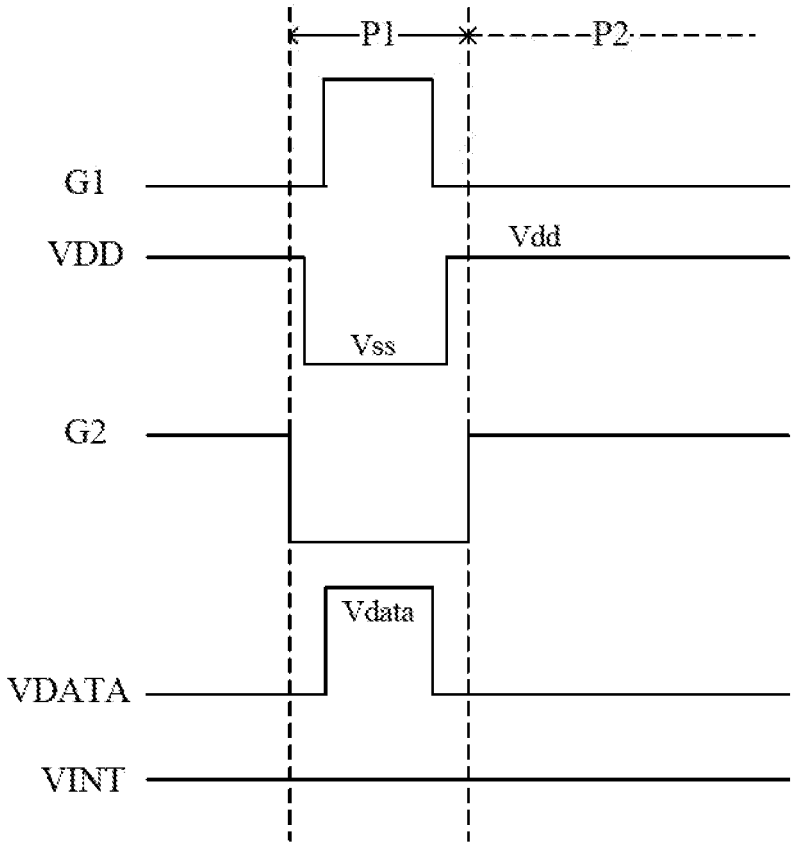
FIG. 4 is a timing diagram of a control signal used in the driving method of the pixel circuit shown in FIG. 3.

FIG. 4 is a timing diagram of a control signal used in the driving method of the pixel circuit shown in FIG. 3. As shown in FIG. 4, in the first phase P1, an ON signal is inputted from the first control signal terminal G1, that is, a high level signal is inputted from the first control signal terminal G1. A first voltage Vss is inputted from the first power supply signal terminal VDD, and the first voltage Vss is in a low level. A data voltage Vdata is inputted from the data signal terminal VDATA. At the time, under the control of the first control signal terminal G1, the the second transistor T2 and the third transistor T3 are turned on, the second transistor T2 writes the first voltage Vss into the first control point A, the third transistor T3 writes the data voltage Vdata into the third control point C, the capacitor C1 stores the voltages at the first control point A and at the third control point C.

Figure 5:
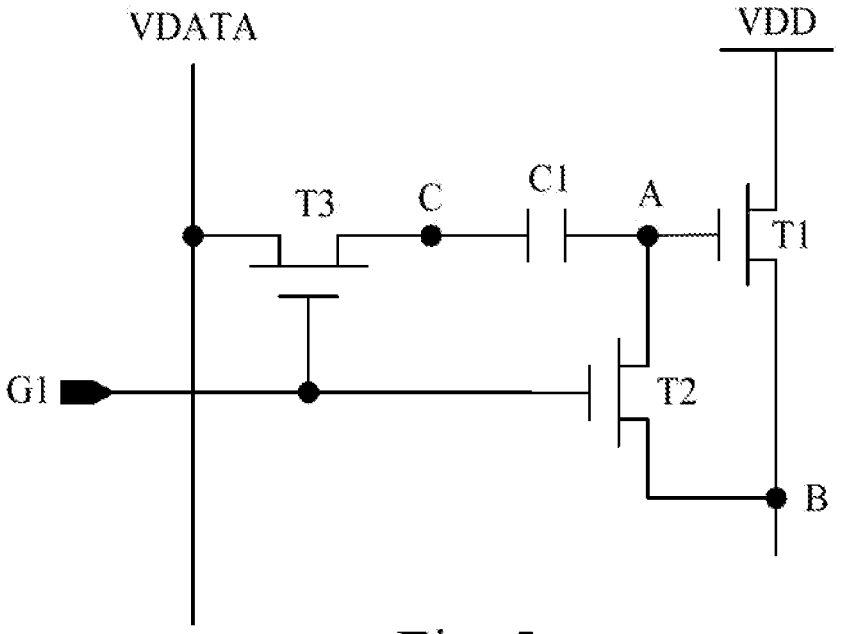
FIG. 5 is an equivalent circuit diagram of the pixel circuit shown in FIG. 2 in a first phase.

FIG. 5 is an equivalent circuit diagram of the pixel circuit shown in FIG. 2 in a first phase. The first phase P1 may be a voltage storage phase. As can be seen from FIG. 5, in the first phase, the second transistor T2 is turned on, so that the connection manner of the first transistor T1 is the same as the connection manner of a diode, and at the time the other end of the capacitor C1 (i.e., the first control point A) can be discharged via the first transistor T1, until the first transistor T1 is turned off. After the first transistor T1 is turned off, the voltage of the other end of the capacitor C1 (i.e., the first control point A) is Vss+Vth, wherein, Vth is the threshold voltage of the first transistor T1, so that the pixel circuit can complete the storage of the data voltage Vdata and the collection of the threshold voltage Vth of the first transistor in the first phase. In the first phase, the organic light emission diode OLED is not in a positive bias state for a long time, and can effectively extend the service life of the organic light emission diode.

Figure 6:
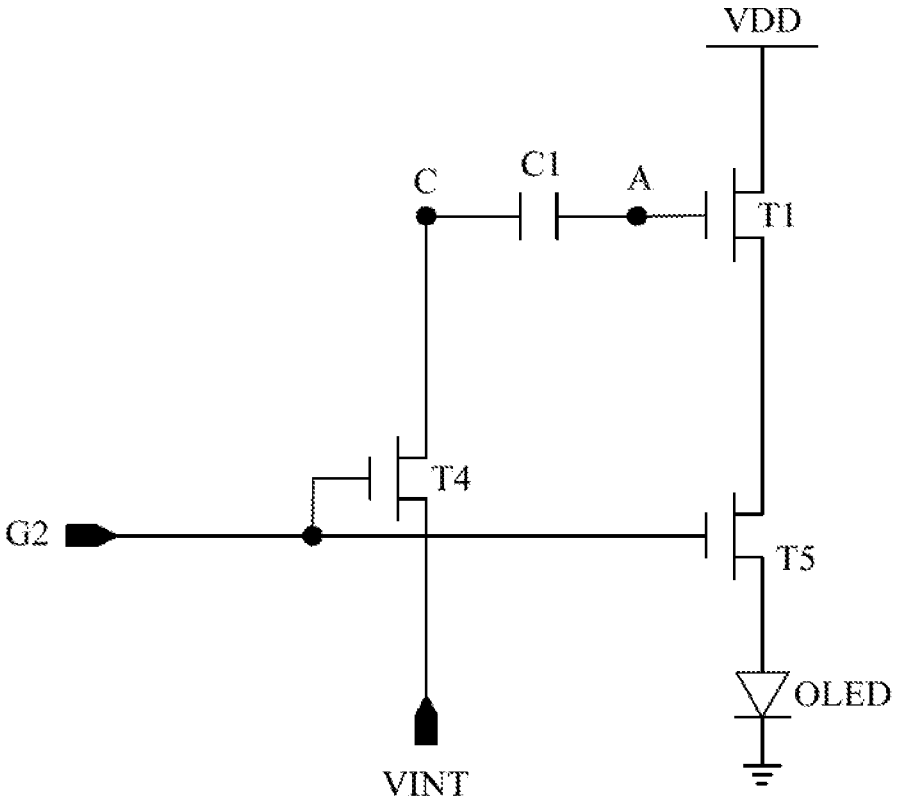
FIG. 6 is an equivalent circuit diagram of the pixel circuit shown in FIG. 2 in a second phase.

FIG. 6 is an equivalent circuit diagram of the pixel circuit shown in FIG. 2 in a second phase. The second phase P2 may be a light emission phase. With reference to FIG. 4, in the second phase P2, an OFF signal is inputted from the first control signal terminal G1, an ON signal is inputted from the second control signal terminal G2, that is, a low level signal is inputted from the first control signal terminal G1, a high level signal is inputted from the second control signal terminal G2. The second voltage Vint is inputted from the second power supply signal terminal VINT, and under the control of the second control signal terminal G2, the fourth transistor T4 and the fifth transistor T5 are turned on, the fourth transistor T4 writes the second voltage Vint into the third control point C, the fifth transistor T5 writes the voltage at the second control point B into the light emission module 60 to drive the light emission module 60 to emit light.

As it can be seen from FIG. 6, in the second phase, since an ON signal is inputted from the second control signal terminal G2, the fourth transistor T4 and the fifth transistor T5 are turned on. Since an OFF signal is inputted from the first control signal terminal G1, the second transistor T2 and the third transistor T3 are turned off. A third voltage Vdd is inputted from the first power supply signal terminal VDD, the third voltage Vdd is in a high level. At the time, the voltage of one end of the capacitor C1 (i.e., the third control point C) rises to Vint because the fourth transistor T4 is turned on. Since the voltage at the third control point C in the first phase is Vdata, the amount of change of the voltage at the third control point C in the second phase is Vint−Vdata, and at the same time the voltage of the other end of the capacitor C1 (i.e., first control point A) rises to Vint−Vdata+Vth+Vss due to the boosting effect of the capacitor, that is, the voltage of the control electrode of the first transistor T1 in the second phase is Vint−Vdata+Vth+Vss. The voltage of the second electrode of the first transistor T1 (in the second phase, the second electrode of the first transistor T1 is the source of the first transistor T1) is Voled+Vss, wherein Voled is the voltage across two ends of the organic light emission transistor OLED, i.e., the operating voltage of the OLED, whereby in the second phase, the gate-source voltage Vgs of the first transistor T1 can be expressed as:

$$Vgs=Vint-V\text{data}+Vth+Vss-Voled-Vss=Vint-V\text{data}+Vth-Voled \quad \text{Equation (1);}$$

Further, in the second phase, the driving current $I_{OLED}$ generated by the first transistor T1 can be expressed as:

$$I_{OLED}=\tfrac{1}{2}K\times(Vgs-Vth)^2=\tfrac{1}{2}K\times(Vint-V\text{data}+Vth-Voled-Vth)^2=\tfrac{1}{2}K\times(Vint-V\text{data}-Voled)^2 \quad \text{Equation (2);}$$

wherein $$K=\frac{W}{L}\cdot C\cdot\mu;$$

Specifically, μ is the carrier mobility for the first transistor T1, C is the capacitance of a control electrode insulating layer of the first transistor T1, and W/L is the width to length ratio of the first transistor T1. From equation (2) it can be seen that, when the organic light emission diode OLED is operating normally, the value of the driving current $I_{OLED}$ for driving OLED is only correlated with the second voltage Vint, the data voltage Vdata and the operating voltage Voled of the OLED, but is independent of the threshold voltage Vth of the first transistor T1, thereby avoiding the impact of the threshold voltage of the driving transistor on the luminous effect of the OLED. In addition, after the OLED operates for a long time, the operating voltage Voled of the OLED will tend to be constant, so that the driving current $I_{OLED}$ also tend to be stable, to further ensure the display effect of the OLED, improving uniformity of display luminance of the display panel.

Figure 7:
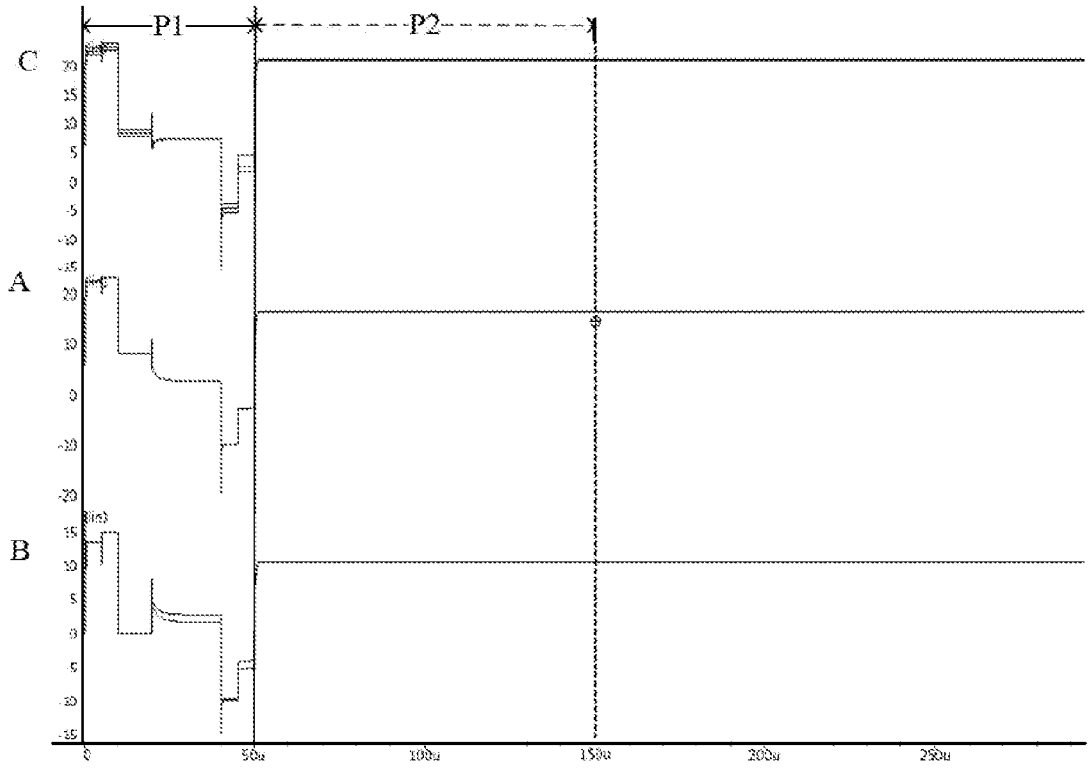
FIG. 7 is a schematic potential change diagram of a first control point, a second control point and a third control point of the pixel circuit shown in FIG. 2.
Figure 8:
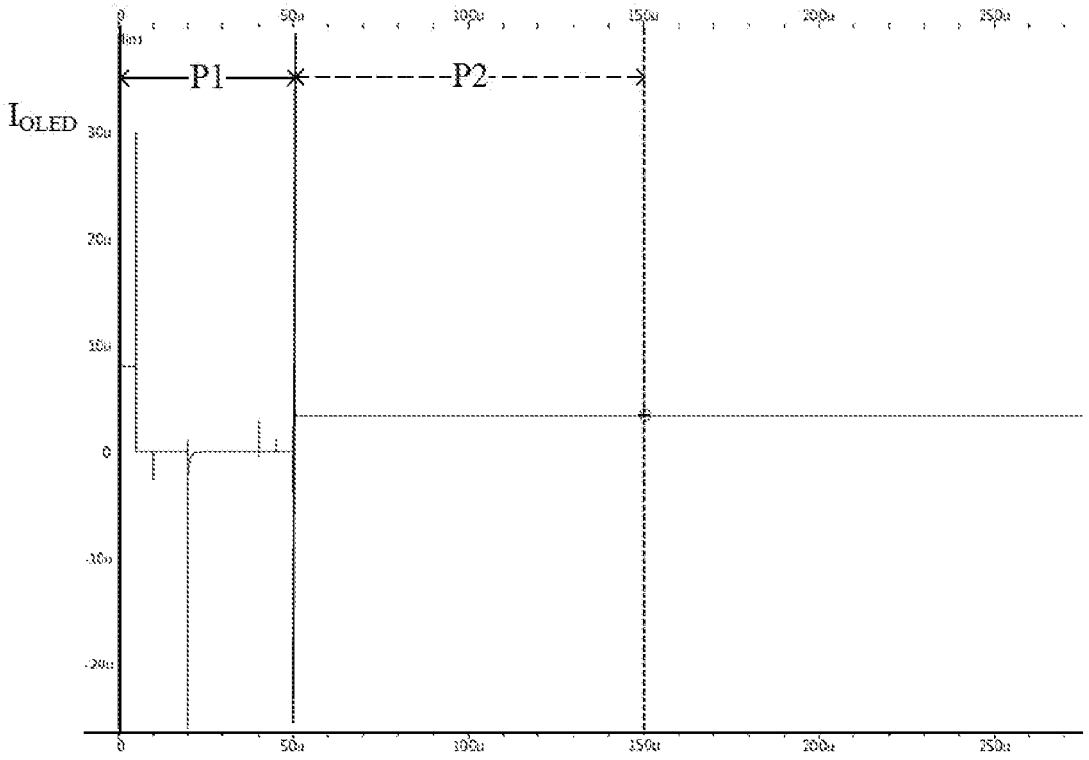
FIG. 8 is a schematic current change diagram of a driving current of the pixel circuit shown in FIG. 2.

FIG. 7 is a schematic potential change diagram of a first control point, a second control point and a third control point of the pixel circuit shown in FIG. 2. FIG. 8 is a schematic current change diagram of a driving current of the pixel circuit shown in FIG. 2. As can be seen in FIG. 8, in the second phase P2, the driving current IOLED of the OLED is relatively stable, that is, the driving current IOLED is less affected by the threshold voltage Vth of the driving transistor, thereby improving uniformity of display luminance of the OLED display panel, and improving the display effect of the OLED display panel.

It should be noted that, in the embodiments of the present disclosure, the first to fifth transistors are all N-type transistors, and the source and drain of each of the transistors are not fixed, but are decided according to the direction of current flowing through the transistor, wherein one end at which the current flows in is the source of the transistor, and one end at which the current flows out is the drain of the transistor. For example, in the first phase P1, the first electrode of the first transistor T1 is the source, the second electrode is the drain, and in the second phase P2, since the voltage at the second control point B is higher, the first electrode of the first transistor T1 is the drain and the second electrode is the source.

The embodiments of the present disclosure provides a driving method of a pixel circuit, the driving method is capable of writing the data voltage input from the data signal terminal into the third control point in the first phase, and writing the first voltage input from the first power supply signal terminal into the second control point and the first control point. The driving method is capable of writing the second voltage input from the second power supply signal terminal into the third control point in the second phase, and driving the light emission module to emit light with the current from the light emission control module. The value of the driving current for driving the light emission module is incorrelated with the threshold voltage of the driving transistor in the pixel circuit, thus avoiding the impact of the threshold voltage of the driving transistor (enhancement type or depletion type) on the display effect, increasing uniformity of display luminance of an OLED display panel, and improving the display effect of the OLED display panel.

The embodiments of the present disclosure provide a display device. The display device may include a pixel circuit that may be the pixel circuit shown in FIG. 1 or 2. The display device may be a liquid crystal panel, e-paper, OLED panel, AMOLED panel, mobile phone, tablet, televisions display, notebook computer, digital picture frame, navigator and any other product or component having a display function.

The foregoing is only some embodiments of the present disclosure and is not intended to limit the present disclosure. Any modification, equivalent replacement, improvement and the like made within the spirit and principle of the disclosure, should be included in the scope of the present disclosure.

What is claimed is:

1. A pixel circuit comprising a drive module, a collection module, a data write module, a storage module, a light emission control module, and a light emission module, wherein the data write module is connected to the storage module, and is configured to write a voltage at a data signal terminal into the storage module, wherein the collection module is connected to the storage module and the drive module, and is configured to collect a threshold voltage of the drive module and write the threshold voltage into the storage module, wherein the storage module is connected to the drive module, and is configured to store a driving voltage for driving the drive module, wherein the drive module is connected to the light emission control module, and is configured to drive the light emission module to emit light according to the driving voltage stored by the storage module, wherein the light emission control module is connected to the light emission module, and is configured to control the drive module for driving the light emission module, wherein a connection point connecting the drive module and the storage module is a first control point, a connection point connecting the drive module and the collection module is a second control point, and a connection point connecting the data write module and the storage module is a third control point, wherein the drive module is connected to a first power supply signal terminal, the first control point, and the second control point respectively, and is configured to write an input voltage at the first power supply signal terminal into the second control point under the control of a voltage at the first control point, wherein the collection module is connected to a first control signal terminal, the first control point, and the second control point respectively, and is confirmed to write the voltage at the second control point into the first control point according to a first control signal inputted from the first control signal terminal, wherein the data write module is connected to the data signal terminal, the first control signal terminal, and the third control point respectively, and is configured to write the voltage at the data signal terminal into the third control point according to the first control signal inputted from the first control signal terminal, wherein the storage module is connected to the first control point and the third control point respectively, and is configured to store the voltages at the first control point and at the third control point, wherein the light emission control module is connected to the second control point, the third control point, a second control signal terminal, a second power supply signal terminal, and the light emission module respectively, and is configured to control the light emission module to emit light according to the voltage at the second control point, the voltage at the third control point, a second control signal from the second control signal terminal, and a voltage at the second power supply signal terminal, and wherein the light emission module is connected to the light emission control module, and is configured to emit light under the control of the light emission control module.

2. The pixel circuit according to claim 1, wherein the drive module comprises a first transistor, wherein the first electrode of the first transistor is connected to the first power supply signal terminal, wherein the second electrode of the first transistor is connected to the second control point, and wherein the control electrode of the first transistor is connected to the first control point.

3. The pixel circuit according to claim 2, wherein the first transistor is an N-type transistor.

4. The pixel circuit according to claim 1, wherein the collection module comprises a second transistor, wherein the first electrode of the second transistor is connected to the first control point, wherein the second electrode of the second transistor is connected to the second control point, and wherein the control electrode of the second transistor is connected to the first control signal terminal.

5. The pixel circuit according to claim 4, wherein the second transistor is an N-type transistor.

6. The pixel circuit according to claim 1, wherein the data write module comprises a third transistor, wherein the first electrode of the third transistor is connected to the data signal terminal, wherein the second electrode of the third transistor is connected to the third control point, and wherein the control electrode of the third transistor is connected to the first control signal terminal.

7. The pixel circuit according to claim 6, wherein the third transistor is an N-type transistor.

8. The pixel circuit according to claim 1, wherein the storage module comprises a capacitor, wherein one end of the capacitor is connected to the third control point, and wherein the other end of the capacitor is connected to the first control point.

9. The pixel circuit according to claim 1, wherein the light emission control module comprises:

a fourth transistor, wherein the first electrode of the fourth transistor is connected to the third control point, wherein the second electrode of the fourth transistor is connected to the second power supply signal terminal, and wherein the control electrode of the fourth transistor is connected to the second control signal terminal, and a fifth transistor, wherein the first electrode of the fifth transistor is connected to the second control point, wherein the second electrode of the fifth transistor is connected to the light emission module, and wherein the control electrode of the fifth transistor is connected to the second control signal terminal.

10. The pixel circuit according to claim 9, wherein the fourth transistor and the fifth transistor are N-type transistors.

11. The pixel circuit according to claim 1, wherein the light emission module comprises an organic light emission diode, wherein one end of the organic light emission diode is connected to the light emission control module, and wherein the other end of the organic light emission diode is grounded.

12. A pixel circuit driving method for driving a pixel circuit according to claim 1, comprising:

a first phase, in which the light emission control module disconnects the drive module and the light emission module, the data write module writes the voltage at the data signal terminal into the storage module, and the collection module collects the threshold voltage of the drive module and writes it into the storage module, and a second phase, in which the light emission control module connects the drive module and the light emission module, and the drive module drives the light emission module to emit light according to the driving voltage stored by the storage module.

13. The method according to claim 12, wherein a connection point connecting the drive module and the storage module is a first control point, a connection point connecting the drive module and the collection module is a second control point, and a connection point connecting the data write module and the storage module is a third control point, wherein in the first phase, an ON signal is inputted from a first control signal terminal, a first voltage is inputted from a first power supply signal terminal, and a data voltage is inputted from a data signal terminal, such that the data voltage is written into the third control point and the first voltage is written into the second control point and the first control point, and wherein in the second phase, an OFF signal is inputted from the first control signal terminal, an ON signal is inputted from the second control signal terminal, the second voltage is inputted from a second power supply signal terminal, such that the second voltage is written into the third control point to drive the light emission module to emit light with the current from the light emission control module.

14. The method according to claim 12, wherein the drive module comprises a first transistor, the collection module comprises a second transistor, the data write module comprises a third transistor, the storage module comprises a capacitor, the light emission control module comprises a fourth transistor and a fifth transistor, and the light emission module comprises an organic light emission diode, wherein in the first phase, an ON signal is inputted from the first control signal terminal, a first voltage is inputted from the first power supply signal terminal, a data voltage is inputted from the data signal terminal, the second transistor and the third transistor are turned on, the second transistor writes the first voltage into the first control point, the third transistor writes the data voltage into the third control point, and the capacitor stores the voltages at the first control point and at the third control point, and wherein in the second phase, an OFF signal is inputted from the first control signal terminal, an ON signal is inputted from the second control signal terminal, the second voltage is inputted from the second power supply signal terminal, the fourth transistor and the fifth transistor are turned on, the fourth transistor writes the second voltage into the third control point, and the fifth transistor writes the voltage at the second control point into the light emission module to drive the light emission module to emit light.

15. The method according to claim 14, wherein the transistors are N-type transistors.

16. A display device, wherein the display device comprises the pixel circuit according to claim 1.

17. The display device according to claim 16, wherein the drive module comprises a first transistor, wherein the first electrode of the first transistor is connected to the first power supply signal terminal, wherein the second electrode of the first transistor is connected to the second control point, and wherein the control electrode of the first transistor is connected to the first control point.

18. The display device according to claim 16, wherein the collection module comprises a second transistor, wherein the first electrode of the second transistor is connected to the first control point, wherein the second electrode of the second transistor is connected to the second control point, and wherein the control electrode of the second transistor is connected to the first control signal terminal.

* * * * *